US007966781B2

(12) United States Patent
Muehlebach

(10) Patent No.: US 7,966,781 B2
(45) Date of Patent: Jun. 28, 2011

(54) PROFILED COVER STRIP SYSTEM WITH A FACING DEVICE FOR A STAIR STEP WHICH IS OPEN ON AT LEAST ONE FRONT SIDE

(75) Inventor: Moritz Muehlebach, Dietlikon (CH)

(73) Assignee: Proverum AG, Baar (CH)

( * ) Notice: Subject to any disclaimer, the term of this patent is extended or adjusted under 35 U.S.C. 154(b) by 49 days.

(21) Appl. No.: 12/529,871

(22) PCT Filed: Apr. 23, 2007

(86) PCT No.: PCT/EP2007/003537

§ 371 (c)(1),
(2), (4) Date: Sep. 3, 2009

(87) PCT Pub. No.: WO2008/116489

PCT Pub. Date: Oct. 2, 2008

(65) Prior Publication Data

US 2010/0083592 A1 Apr. 8, 2010

(30) Foreign Application Priority Data

Mar. 26, 2007 (DE) ..... 10 2007 014 858

(51) Int. Cl.
*E04F 11/022* (2006.01)
*E04F 11/104* (2006.01)

(52) U.S. Cl. ..... 52/177; 52/181; 52/183; 52/184; 52/174

(58) Field of Classification Search ..... 52/177, 52/179, 180, 181–182, 183–184, 187–188, 52/191, 185–186, 189–190, 178
See application file for complete search history.

(56) References Cited

U.S. PATENT DOCUMENTS

| | | | | |
|---|---|---|---|---|
| 718,821 | A * | 1/1903 | Cooper | 52/179 |
| 5,252,376 | A * | 10/1993 | Greenberg et al. | 428/99 |
| 6,141,920 | A * | 11/2000 | Kemper | 52/179 |
| 6,920,725 | B2 * | 7/2005 | Lanphier | 52/182 |
| 7,207,143 | B2 * | 4/2007 | Stanchfield | 52/459 |
| 7,389,613 | B2 * | 6/2008 | Sondermann | 52/179 |

FOREIGN PATENT DOCUMENTS

| | | | |
|---|---|---|---|
| DE | 92 14 771 | U1 | 12/1992 |
| DE | 94 00 466 | U1 | 2/1994 |
| DE | 200 22 352 | U1 | 7/2001 |
| EP | 0 334 104 | A1 | 9/1989 |
| GB | 2 192 212 | A | 1/1988 |
| GB | 2 202 192 | A | 9/1988 |

OTHER PUBLICATIONS

International Search Report for International Application No. PCT/EP2007/003537.

* cited by examiner

*Primary Examiner* — Jeanette E. Chapman
(74) *Attorney, Agent, or Firm* — Roberts Mlotkowski Safran & Cole, P.C.; David S. Safran

(57) ABSTRACT

A profiled cover strip system (1) for finishing a bottom covering (2) on a step (3) open on at least one front side (4), the system having an upper covering profiled element (12). A facing device (16) having a facing cap (18) provided with a facing plate (17) for facing the profiled cover strip system (1) on the front side, and at least one facing cover strip (19, 20) separate from the facing cap (18), for facing the bottom covering on the front side (2), is used.

15 Claims, 5 Drawing Sheets

PROFILED COVER STRIP SYSTEM WITH A FACING DEVICE FOR A STAIR STEP WHICH IS OPEN ON AT LEAST ONE FRONT SIDE

BACKGROUND OF THE INVENTION

1. Field of Invention

The invention relates to a profiled cover strip system for closing off a floor covering on a stair step which is open on at least one front side, with a top cover profile.

2. Description of Related Art

Profiled cover strip systems of the aforementioned type are already known from practice. While installation of floor coverings is comparatively simple even in the stair step region, it is often difficult to achieve a clean closing edge on the edges of the floor coverings for steps. Therefore, for closing off the edge of steps, profiled cover strip systems of the initially mentioned type which are conventionally called step cover strip systems are used. These step cover strip systems, in the simplest embodiment, can be simply be a cover profile. In order to be able to ensure vertical adjustability of the step cover strip system, profiled cover strip systems are also known which, in addition to the top cover profile, have a bottom base profile, and the base profile and the cover profile can be connected to one another and the cover profile can be installed relative to the base profile in different vertical positions. This vertical adjustability is generally necessary since profiled cover strip systems must be adaptable to different covering thicknesses.

While a front-side edge covering is easily possible by way of the known profiled cover strip systems, for stair steps that are open on the front side, the problem is that, not only the floor covering, but especially also the hollow profile and thus the "inner life" of the profiled cover strip system can be seen; this is aesthetically very unattractive. In order to conceal the edge of the floor covering and especially the front side of the profiled cover strip system, blind strips are conventionally used which are joined to the front side of the covering and are attached there. These blind strips are conventionally routed as far as the profiled cover strip system. While concealing the front side of the covering by way of the blind strip is generally possible without difficulty, in the region of the profiled cover strip system problems arise since the profiled cover strip system often does not have a clean closing edge.

The facing of the front side of this profile is therefore generally problematical. Special difficulties arise by the profiled cover strip systems not having an exactly predefinable height. The height of the profiled cover strip system depends ultimately on the respective installation situation and thus on the height of the covering used.

SUMMARY OF THE INVENTION

The object of the invention is to provide a profiled cover strip system for stair steps of the initially named type in which the aforementioned disadvantages are avoided.

To achieve the aforementioned object, in a profiled cover strip system of the initially mentioned type, there is a facing device which has a facing cap which has a facing plate for front-side facing of the profiled cover strip system and a facing cover strip which is separate from the facing cap for front-side facing of the floor covering. For the first time, the invention makes available a facing system which is designed for facing of stair steps which are open on the front side, the facing device being matched to special requirements in that the facing device has at least two parts, specifically a facing cap for front-side facing of the profiled cover strip system and a facing cover strip separate therefrom for front-side facing of the floor covering. Here, it goes without saying that the facing cap is matched to the special shape of the profiled cover strip system, while the facing cover strip is in turn adapted to the floor covering.

In order to achieve complete facing of the cross section-side front surface of the profiled cover strip system, the facing plate has a greater lengthwise and transverse extension than the cover profile. In this way, ultimately, it can be ensured that the cross-sectional area of the profiled cover strip system is covered over the entire surface by the facing plate. Otherwise, it is a good idea if the facing device has not only a facing cover strip for horizontal arrangement, but also another facing cover strip for vertical arrangement. For certain stair steps, it is specifically such that, not only the horizontal tread region, but also the vertically extending region of the stair step, has a covering which should be faced then in the same manner as the horizontal floor covering by way of a facing cover strip.

In order to conceal the transitions between the profiled cover strip system and covering, in any case, the facing plate in the direction to the horizontal covering and toward the bottom projects over the cover profile, preferably by more than 5 mm.

In order to have a clean transition from the facing cap to the facing cover strip, the facing plate overlaps the facing cover strip in the installed state on the end side. The overlapping ensures that rough edges of the facing cover strip are concealed.

In this connection, it is recommended that there is at least one recess for the end of the facing cover strip on the back of the facing plate which faces the profiled cover strip system. An almost continuous transition from the facing cover strip to the facing cap can be achieved by this recess which should be matched to the facing cover strip.

In order to have a clean transition from the facing cap to the cover profile, which is especially important for rough edges of the cover profile, on the back of the facing plate which faces the profiled cover strip system, there is an outer edge which overlaps the cover profile on the edge side. This edge is provided only on the top side and the front side of the cover profile, while the facing plate is without an edge on its side facing the horizontal floor covering and also on the bottom side, therefore, ultimately, the sides on which the facing cover strip, and optionally, the other facing cover strip are provided. The edge should otherwise enable an overlap of more than 5 mm.

Moreover, it is favorable that the edge constitutes not only the outer top-side and lengthwise-side boundary of the facing plate, the shape of the edge should also be matched to the top-side and front-side cross-sectional shape of the cover profile, preferably such that at least essentially there is freedom from play between the resting edge and the top side and lengthwise side of the cover profile.

In order to enable accessibility to the profiled cover strip system after installation, it is recommended that the facing cap can be detachably connected to the profiled cover strip system. Fundamentally, there is a plurality of possibilities of detachable connectivity. A projecting leg provided on the back of the facing cap has proven especially advantageous; it is intended for frictional engagement with the corresponding receptacle on the profiled cover strip system. The leg can be especially a flat rectangular leg. Otherwise, the receptacle should be in the middle region of the cross section of the profiled cover strip system or should project into this region. Differently than a frictional connection in the edge region, a fastening or receptacle which lies outside the edge has the advantage that the attachment point is not distorted even when the profiled cover strip system is loaded, for example, when treading on the profile system.

In order to be able to ensure not only a clean transition to the profiled cover strip system, but also to the floor covering, the facing cover strip is made as an angular profile and has a facing leg toward the front-side facing of the floor covering and an edge leg bent from it for resting on the floor covering on the top. The cut edges of the floor covering are concealed by the edge leg which conventionally projects from the facing leg by 90°.

In this connection, it is preferred that the length of the edge leg and the length of the edge of the facing cap are matched to one another such that, in the installed state, there is the same projecting length. With consideration of the fact that the facing cap overlaps the facing cover strip, it is ultimately such that the edge on the facing cap is somewhat higher than the edge of the facing cover strip.

Otherwise, the facing cover strip can be detachably connected to the floor covering. But, it is also possible that the facing cover strip is intended for a fixed connection to the floor covering. This can be done, for example, by way of a screw and/or cement connection.

It was already pointed out initially that the invention can be used for stair step profiled cover strip systems which have only an upper cover profile which is especially cemented or screwed for attachment. However, the invention can also be used for stair step cover strip systems in which, in addition to the cover profile, there is a lower base profile, and the base profile and the cover profile can be connected to one another and the cover profile can be installed relative to the base profile in different vertical positions. It is especially advantageous in this connection if, on the cover profile, there is a supporting means for support and supplementary vertical adjustment, especially if there is no base profile.

It goes without saying that this invention relates not only to the above described profiled cover strip system with the facing device, but also to the facing device as such which is then, however, intended for the specific application in a profiled cover strip system for closing off a floor covering on a stair step which is open on at least one front side. This facing device, as a result, is characterized by facing by which covering in three directions is possible.

Other features, advantages and possible applications of this invention will become apparent from the following description of embodiments using the drawings and the drawings themselves.

DETAILED DESCRIPTION OF THE INVENTION

Figure 1:
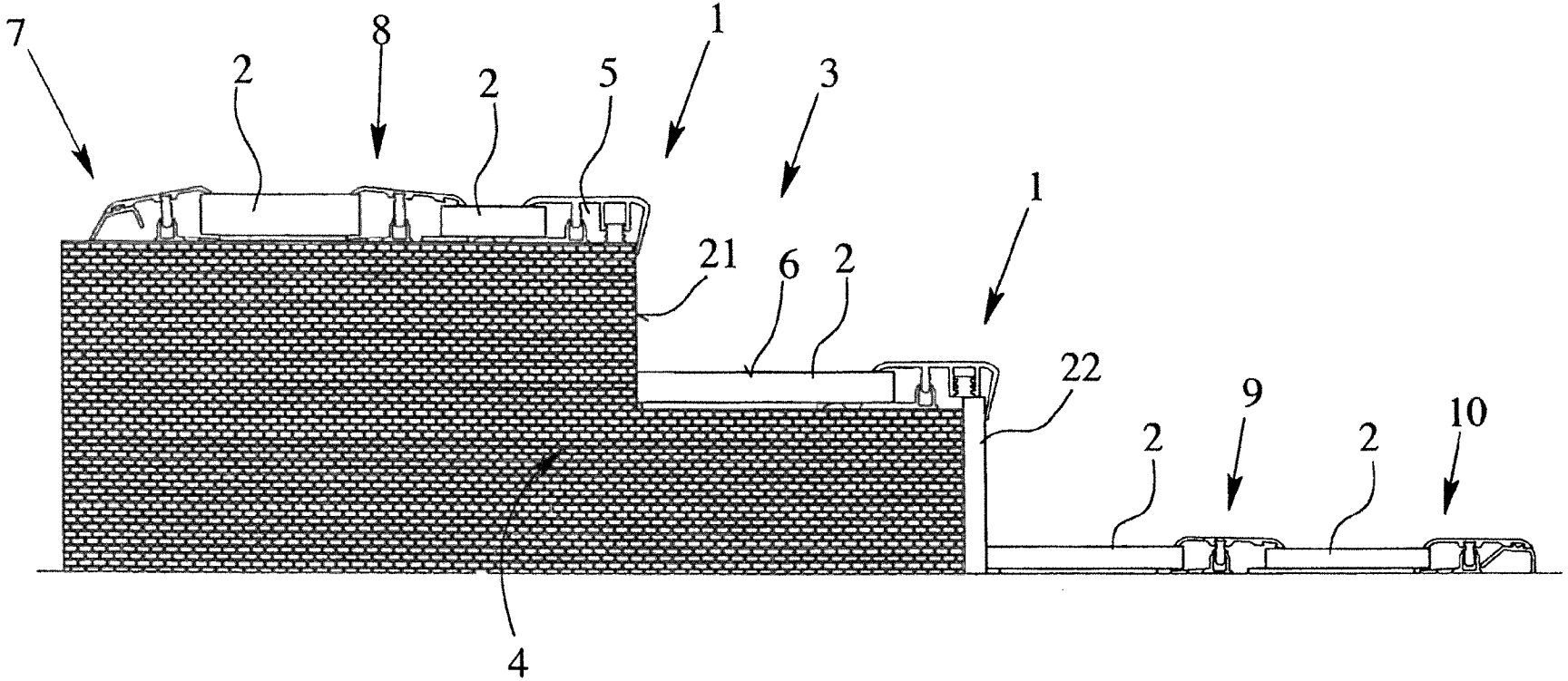
FIG. 1 shows a cross-sectional view of a stair step situation with different profiled cover strip systems.

FIG. 1 shows a stair step situation in which two profiled cover strip systems 1 are shown in two different installation situations for closing off a floor covering 2 in the region of the stair step 3. The profiled cover strip systems 1 are ultimately so-called stair step profile systems which are only used in stair step installation situations. The stair step 3 is open at least on a front side 4 so that the respective front sides 5 of the profiled cover strip systems 1 and the front sides 6 of the floor coverings can be recognized.

In addition to the profiled cover strip systems 1 for the stair step region, there are other profiled cover strip systems 7, 8, 9 and 10. The profiled cover strip systems 7 to 10 illustrate different installation situations. Thus, the profiled cover strip systems 7, 10 are used for closing off the edge, while the profiled cover strip systems 8, 9 are intended for covering the joint. In particular, in the profiled cover strip systems 7, 8, it can be recognized that different heights of the floor covering 2 can be easily encompassed by way of the profiled cover strip systems.

Figure 2:
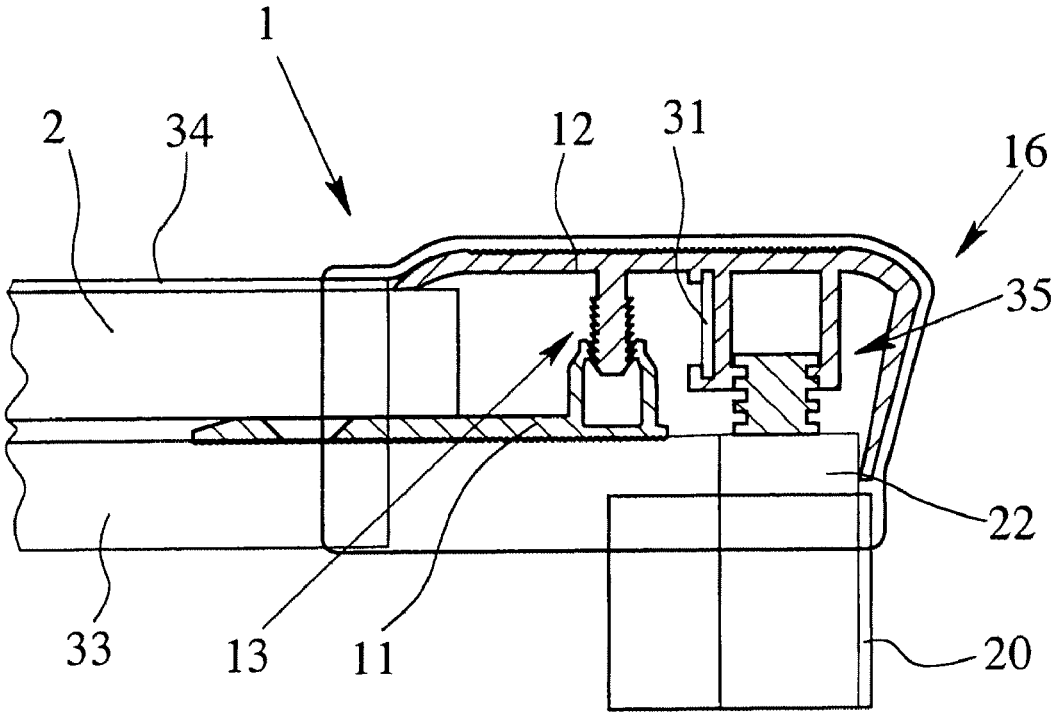
FIG. 2 shows a side view of a profiled cover strip system in accordance with the invention with a facing device.
Figure 4:
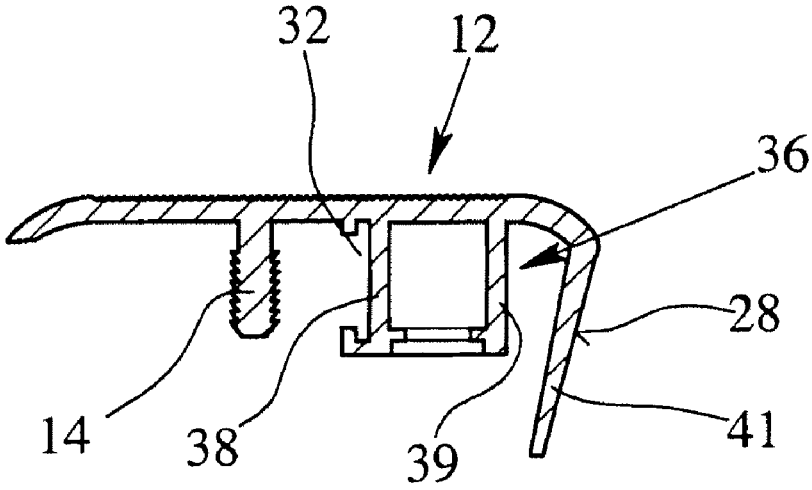
FIG. 4 shows a side view of the cover profile of the profiled cover strip system.
Figure 5:
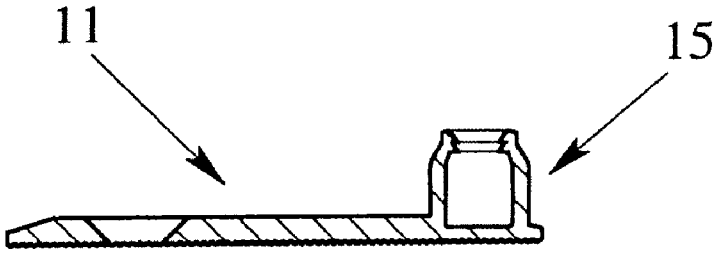
FIG. 5 shows a side view of the base profile of the profiled cover strip system.

The profiled cover strip system 1 from FIG. 1 is shown enlarged in FIG. 2. The profiled cover strip system 1 has a bottom elongated base profile 11 (FIG. 5) and a top elongated cover profile 12 (FIG. 4). Between the base profile 11 and the cover profile 12 there is a latching connection 13 in order to connect the two profiles 11, 12 to one another. The latching connection 13 however has not only a connecting function, but otherwise also ensures vertical adjustability of the cover profile 12 relative to the base profile 11. The latching connection 13 is composed of a latching leg 14 and a latching receptacle 15. Here, the latching leg 14 is made in one piece with the cover profile 12. But, fundamentally, a multipart execution is also possible, as is shown, for example, in the profiled cover strip systems 7 to 10. Otherwise, it is pointed out that the invention is not limited to the illustrated latching connection 13, therefore fundamentally, there can also be latching connections of another type.

It is not shown that the profiled cover strip system 1 can also manage without the base profile 11. In this case, then, the latching connection 13, and thus, the latching leg 14 are not provided on the cover profile. The cover profile is then connected in some other way to the subfloor and/or the covering, for example, by cementing or screws. Otherwise, however, all of the features described below, especially with respect to the supporting means 35, also relate to embodiments in which there is no base profile 11 or latching connection 13.

It is now provided that the profiled cover strip system 1 has a facing device 16 with a facing cap 18 which has a facing plate 17 for front-side facing of the profiled cover strip system 1 and with at least one facing cover strip 19 which is separate from the facing cap 18 for front-side facing of the floor covering 2. In the embodiments shown in FIGS. 2, 3 and 8, in addition to the facing cover strip 19, there is another facing cover strip 20. The additional facing cover strip 20 can be eliminated when an installation situation arises on the top step as in the profiled cover strip system 1 in FIG. 1 when there is no covering element in the vertical stair step region 21. However, if there is a vertical covering element 22, as is shown in FIG. 1 for the lower step, there can be another facing cover strip 20.

Figure 3:
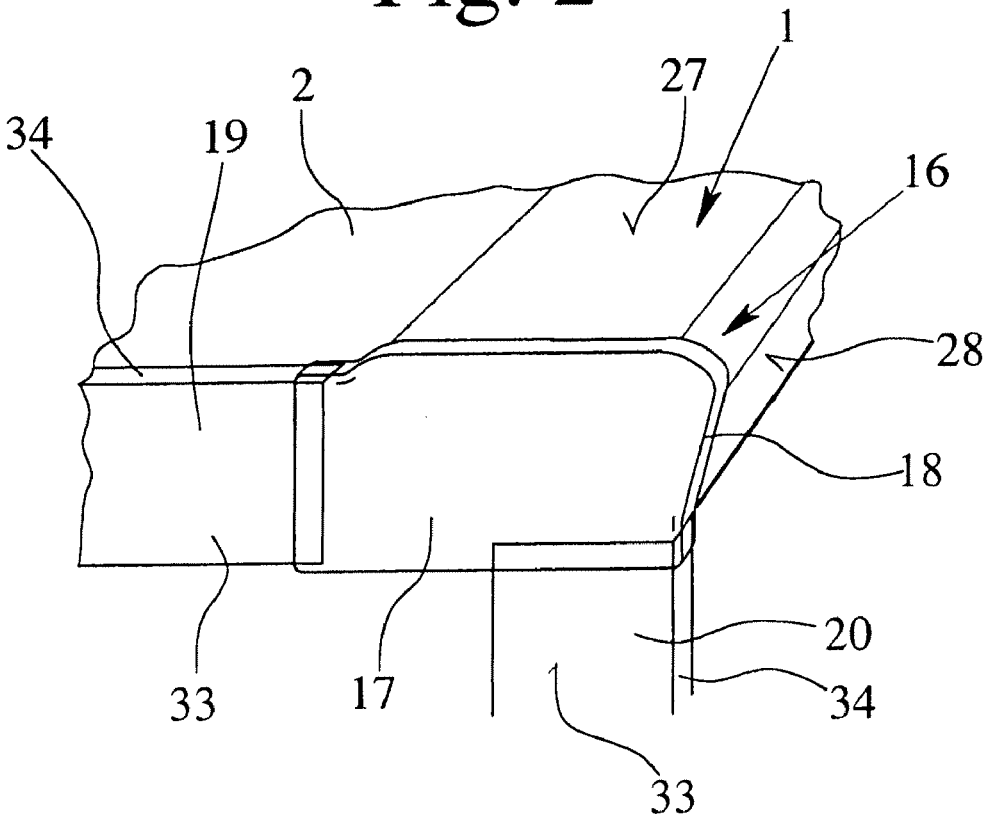
FIG. 3 shows a schematic perspective view of the profiled cover strip system in accordance with the invention.

In particular, FIG. 3 illustrates that the facing plate 17 of the facing cap 18 has a greater lengthwise and transverse extension than the cover profile so that the cross-sectional area encompassed by the cover profile 12 is overlapped over the entire area by the facing plate 17. As shown especially in FIGS. 2, 3 and 8, the facing plate 17, in the direction toward the horizontal covering 2, but also toward the vertical covering element 22 and thus toward the bottom projects over the cover profile 12, here by more than 5 mm.

Figure 7:
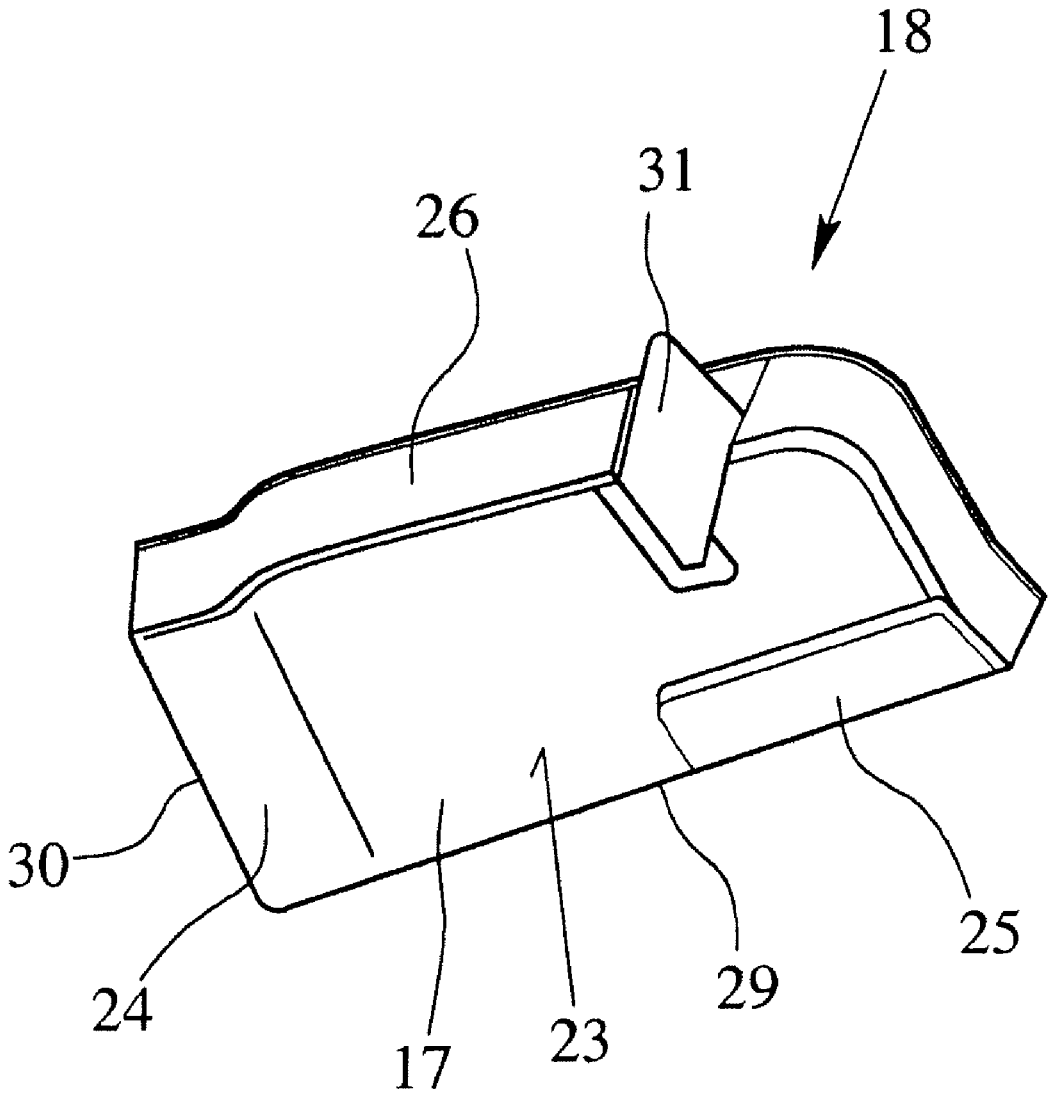
FIG. 7 shows a perspective view of a facing cap and FIG. 8 shows a perspective view of a facing cap with the facing cover strip attached.

Otherwise, the figures show that the facing plate 17 overlaps the two facing cover strips 19, 20 in the installed state on the end side. Here, especially FIG. 7 shows that, on the back 23 of the facing plate 17, there are two recesses 24, 25 for the respective ends of the facing cover strips 19, 20 (see, FIG. 8). The recesses 24, 25 each have a rectangular shape and as a result lead to a reduction of the thickness of the facing plate 17 relative to adjacent regions. The facing plate 17 therefore has a reduced wall thickness in the region of the stops 24, 25.

In particular, FIGS. 7 and 9 show that there is an edge 26 on the facing cap 18 on the back 23 of the facing plate 17. The edge 26 projects roughly at a right angle from the back 23 of the facing plate 17 and is used to overlap the top 27 and the front 28 of the cover profile 12. There is no projecting edge on the lower edge 29 and on the edge 30 facing the covering 2. The shape of the edge 26 is matched to the top-side and front-side cross-sectional shape of the cover profile 12, the edge 26 in the installed state resting at least essentially without play on the top side and front side of the cover profile. Here there is an overlap of at least 5 mm.

The facing cap 18 is otherwise detachably connected to the profiled cover strip system 1. For this purpose, on the back 23 of the facing cap 18, there is a projecting leg 31 which is used for frictional engagement with a corresponding receptacle 32 on the profiled cover strip system 1. The leg 31 has the shape of an elongated rectangle. It is such that at least the lower part of the leg 31 is routed into the middle region of the facing cap 18. In this way, there is a distortion-free arrangement of the facing cap 18 in the installed state.

Figure 8:
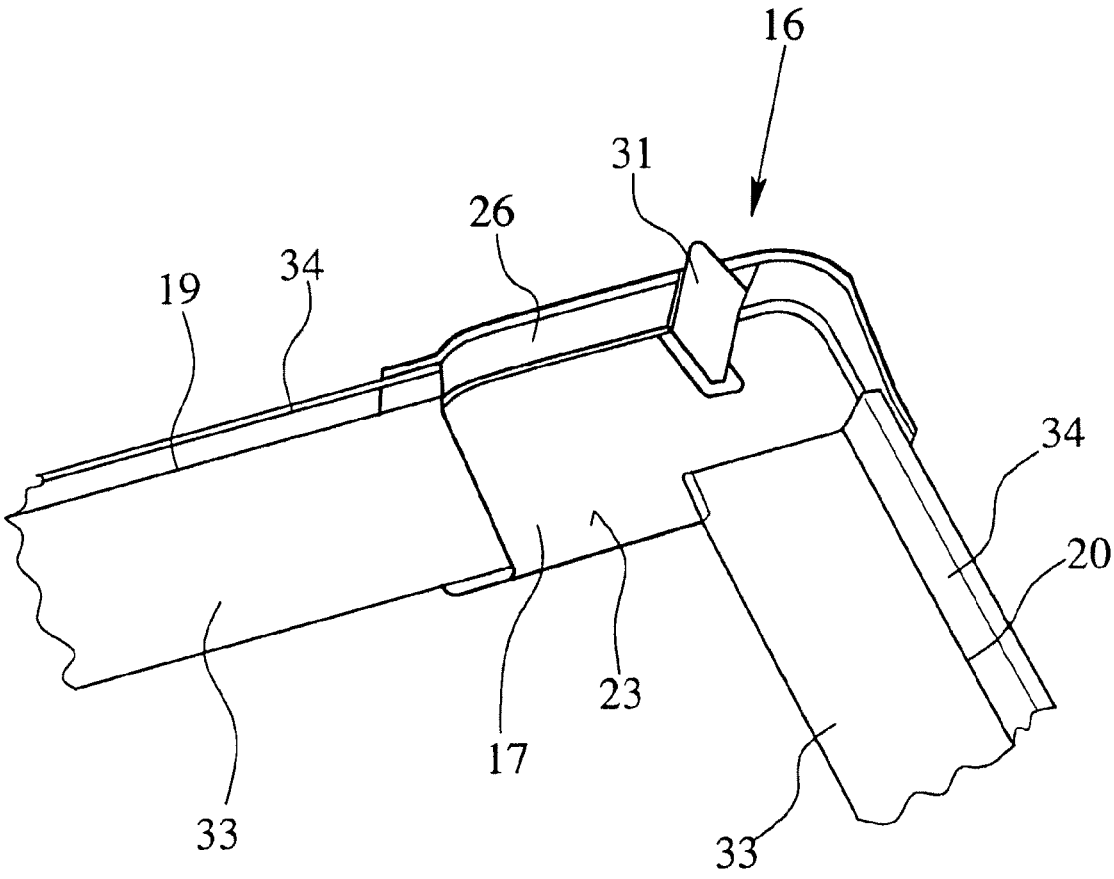

In particular, FIGS. 3 and 8 illustrate that the facing cover strips 19, 20 are each made as angle profiles and each have a facing leg 33 for front-side facing of the floor covering 2 or of the vertical covering element 22 and the edge leg 34 for top-side resting on the floor covering 2.

The length of the edge leg 34 and the length or height of the edge 26 of the facing cap 18 are matched to one another such that, in the installed state, the same projecting length arises, as is indicated in FIG. 3. The facing cover strips 19, 20 are cemented in this case to the floor covering 2 and the vertical covering element 22.

The individual parts of the profiled cover strip system 1 are otherwise parts which consist either of the same material or have the same surface composition. Except for the facing cap 18, all components can be elongated strips made, for example, of aluminum. The facing cap can be an aluminum casting.

Otherwise, the profiled cover strip system 1 has a support means 35 which is provided between the base profile 11 and the cover profile 12. The support means 35 has a stationary support base 36 and a support element 37. The support element 37 can move relative to the support base 36 and is intended for vertical equalization. The support base 36 is made as a slotted receptacle which is formed by two outer receptacle legs 38, 39. The support element 37 can be inserted into the receptacle at different vertical locations and can be fixed in it. On the receptacle legs 38, 39, there is a respective engagement projection for engaging corresponding engagement grooves 40 provided on the support element 37. On the support element 37, there is a plurality of engagement grooves 40 in order to achieve a plurality of vertical positions. Thus, for example, FIG. 1 shows two different vertical positions of the support element 37. Here, the support means 35 ensures that, when the profiled cover strip system 1 is loaded from overhead, there is reliable holding and support.

Figure 6:
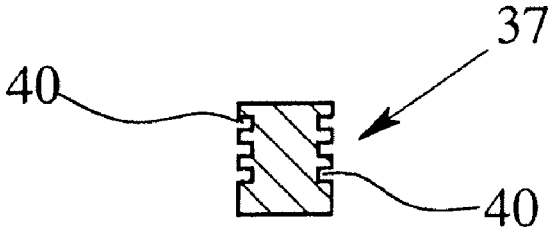
FIG. 6 shows a side view of a support element for a profiled cover strip system in accordance with the invention.

FIG. 6 shows that the distance of the top end of the support element 37 to the uppermost engagement groove 40 is not equal to the distance of the lower end of the support element 37 to the lowermost engagement groove 40. In this way, for example, six different installation situations can be achieved for three engagement grooves on each side of the support element 37 which is likewise made as an elongated strip. Otherwise, as is not shown, the top side and/or bottom side of the support element 37 can be rounded.

FIG. 4 shows that the receptacle 32 is adjacent to the receptacle leg 38, the receptacle 32 extending vertically. Otherwise the support base 36 has a height which is distinctly less than the outside leg 41 of the cover profile 12 which is pointed roughly vertically and whose outside forms the front side 28. The length of the outside leg 41 is intentionally chosen such that the lower end of the outer leg 41 is located underneath the base profile 11 even in the highest locking position.

The invention claimed is:

1. A profiled cover strip system, comprising:

a facing device having a facing cap which has a facing plate for covering a front end of a side edge of a step and a top cover profile for covering a front edge of the step and for closing off a floor covering on the stair step, the top cover profile being open on at least the side edge of the step, and at least one facing cover strip which is separate from the facing cap for covering a remaining portion of the side edge of the step, wherein the facing cap is detachably connectable to the profiled cover strip system by means of frictional engagement between a plate-shaped leg that projects from the facing cap at a rear side thereof into engagement with a laterally open receptacle within the top cover profile, said plate-shaped leg being adapted to prevent distortion of the facing cap in an installed state thereof.

2. Profiled cover strip system as claimed in claim 1, wherein the facing plate has a greater lengthwise and transverse extension than the cover profile.

3. Profiled cover strip system as claimed in claim 1, comprising a second facing cover strip for vertical arrangement.

4. Profiled cover strip system as claimed in claim 1, wherein the facing plate projects over the cover profile in a direction toward the horizontal covering and downward, each by more than 5 mm.

5. Profiled cover strip system as claimed in claim 1, wherein the facing plate overlaps the facing cover strip on an end side in an installed state.

6. Profiled cover strip system as claimed in claim 1, wherein at least one recess for an end of the facing cover strip is provided on a back of the facing plate which faces the profiled cover strip system.

7. Profiled cover strip system as claimed in claim 1, wherein on the back of the facing plate there is an outer edge which overlaps the cover profile on an edge side.

8. Profiled cover strip system as claimed in claim 7, wherein the edge overlaps the cover profile overlaps only on a top side and on a front side of the cover profile.

9. Profiled cover strip system as claimed in claim 7, wherein the shape of the edge is matched to a top-side and front-side cross-sectional shape of the cover profile and wherein the edge rests at least essentially without play on the cover profile.

10. Profiled cover strip system as claimed in claim 1, wherein the receptacle is located in a middle region of the cross section of the facing cap.

11. Profiled cover strip system as claimed in claim 1, wherein the facing cover strip is an angle profile and has a facing leg for front-side facing of the floor covering and an edge leg for resting on the top side of the floor covering.

12. Profiled cover strip system as claimed in claim 11, wherein the length of the edge leg and the length of the edge of the facing cap are matched to one another such that, in the installed state, they have the same projecting length.

13. Profiled cover strip system as claimed in claim 1, wherein the facing cover strip is detachably connectable to the floor covering.

14. Profiled cover strip system as claimed in claim 1, wherein the facing cover strip is fixedly connectable to the floor covering.

15. Profiled cover strip system as claimed in claim 1, further comprising a lower base profile, and wherein the lower base profile and the cover profile are connectable to one another and wherein the cover profile is installable relative to the lower base profile in different vertical positions.

* * * * *